United States Patent [19]

Leistikow et al.

[11] 4,285,156

[45] Aug. 25, 1981

[54] TOY TOILET

[75] Inventors: Gerard K. Leistikow, San Pedro; Henry R. Hales, Hawthorne, both of Calif.

[73] Assignee: Mattel, Inc., Hawthorne, Calif.

[21] Appl. No.: 117,694

[22] Filed: Feb. 1, 1980

[51] Int. Cl.[3] ..... A63H 3/52; A63H 33/00

[52] U.S. Cl. ..... 46/14; 46/1 R

[58] Field of Search ..... 46/39, 40, 116, 1 R, 46/14; 366/267–269

[56] References Cited

U.S. PATENT DOCUMENTS

| | | | |
|---|---|---|---|
| 886,626 | 5/1908 | McNeel | 366/269 |
| 1,645,749 | 10/1927 | Gilbertson | 366/269 |
| 1,856,734 | 5/1932 | Shriver | 366/269 |
| 3,534,496 | 10/1970 | Gardel et al. | 46/116 |
| 3,842,531 | 10/1974 | Sloan | 46/116 |
| 4,056,895 | 11/1977 | Terrulli | 46/1 R |

*Primary Examiner*—Gene Mancene
*Assistant Examiner*—Michael J. Foycik
*Attorney, Agent, or Firm*—Reagin & King

[57] ABSTRACT

A toy toilet includes a toilet bowl, a seat supported by the toilet bowl, a hinged cover for the seat, and a reservoir. Positioned in the reservoir is a cylinder and piston arrangement having a fluid conduit to the toilet bowl and a mechanical linkage to the cover so that the movement of the cover moves the piston to "flush" the toilet.

2 Claims, 4 Drawing Figures

TOY TOILET

BACKGROUND OF THE INVENTION

This invention relates to toys and, more particularly, to a toy toilet which may be used in play settings with a doll.

There have been many toys devised which allow a child to play with dolls as through they were human. For example, doll houses serve this purpose. Doll houses are often outfitted with toy furniture includng chairs, tables, beds, and the like which allow the child to emulate various human situations realistically. More recently, various pieces of toy bathroom furniture have been devised. For example, U.S. Pat. No. 3,842,531 issued to C. C. Sloan, Oct. 22, 1974, and U.S. Pat. No. 3,998,001 issued to Marvin Glass and Associates, Dec. 21, 1976, both disclose toy showers for dolls; and U.S. Pat. No. 3,534,496 issued to Lettam, Inc., Oct. 20, 1970, shows a toy chamber pot for dolls.

It is an object of this invention to provide an improved toy toilet for a doll.

It is another object of this invention to provide an expecially realistic toilet which may be used with dolls for emulating a bathroom setting.

SUMMARY OF THE INVENTION

The foregoing and other objects of the invention are accomplished by a toy toilet which includes a reservoir, a toilet bowl, a hinged toilet cover, and a toilet seat. The reservoir has positioned therein a cylinder and piston arrangement actuated by the lifting of the hinged toilet cover to drive water from the reservoir into the bowl of the toilet in such a manner as to emulate the flushing of a toilet. Closing the toilet cover reverses the action of the piston thereby removing a substantial portion of the water from the toilet bowl and completing the simulated flushing operation.

Other objects, features, and advantages of the invention will become apparent from a reading of the specification when taken in connection with the drawings in which like reference numerals refer to like elements in the several views

DESCRIPTION OF THE PREFERRED EMBODIMENT

Figure 1:
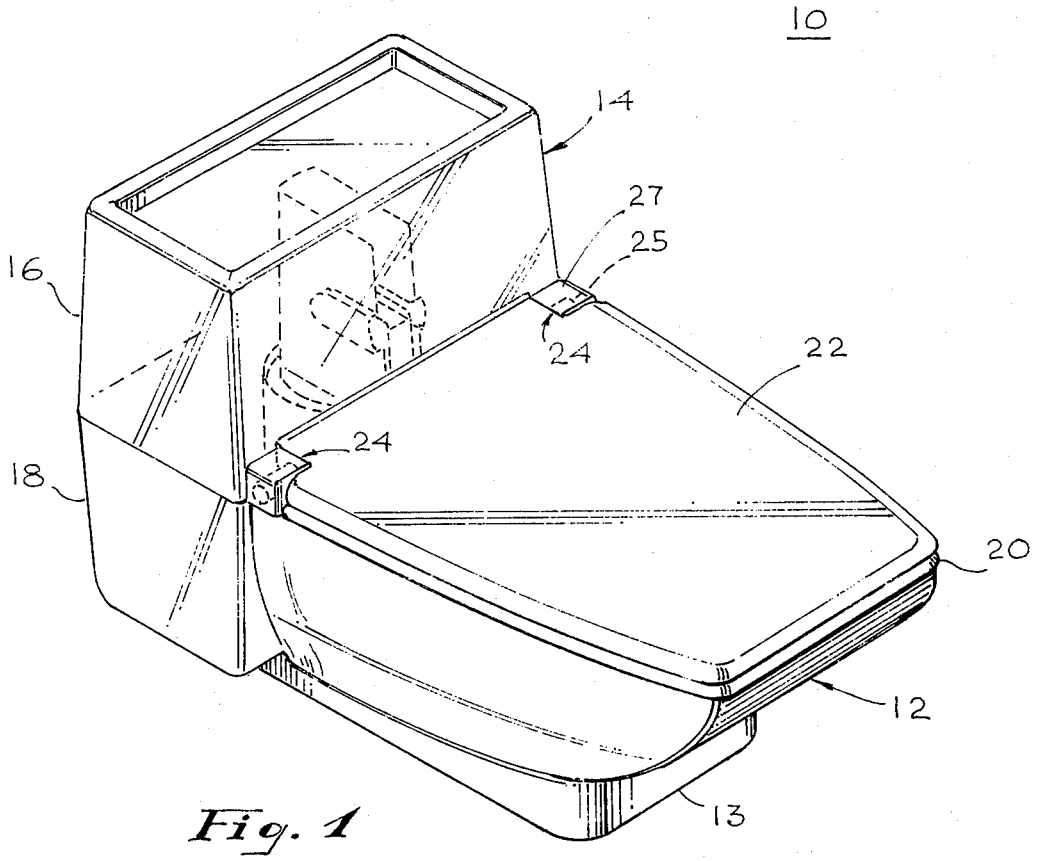
FIG. 1 is a perspective view of a toy toilet constructed in accordance with the invention.

Referring now to the drawings and, more particularly, to FIG. 1, there is shown a toy toilet 10 constructed in accordance with the invention. The toilet 10 comprises a toilet bowl 12 which may be constructed of a molded plastic material well known in the art and which is supported on a molded base 13 which may be constructed of the same molded material. Attached to the bowl 12 is a reservoir 14 having an upper portion 16 and a lower portion 18. The portions 16 and 18 may also be constructed of moldable plastic material, and in a preferred embodiment the lower portion 18 is molded in a single piece with the bowl 12 and the base 13. Affixed to the upper surface of the bowl 12 is a toilet seat 20. The seat 20 is covered by a toilet seat cover 22 which is rotatably attached at a pair of hinges 24 to the toy toilet 10.

In a play situation, the cover 22 is raised by rotating it about the hinges 24, and water is placed in the bowl 12. Upon closing the cover 22, a portion of the water in the bowl 12 is withdrawn and stored in the reservoir 14 in a manner which will be explained hereinafter. When the cover 22 is next opened, the water is forced from the reservoir 14 into the bowl 12 under pressure so that it appears that the toilet 10 has been flushed.

Figure 2:
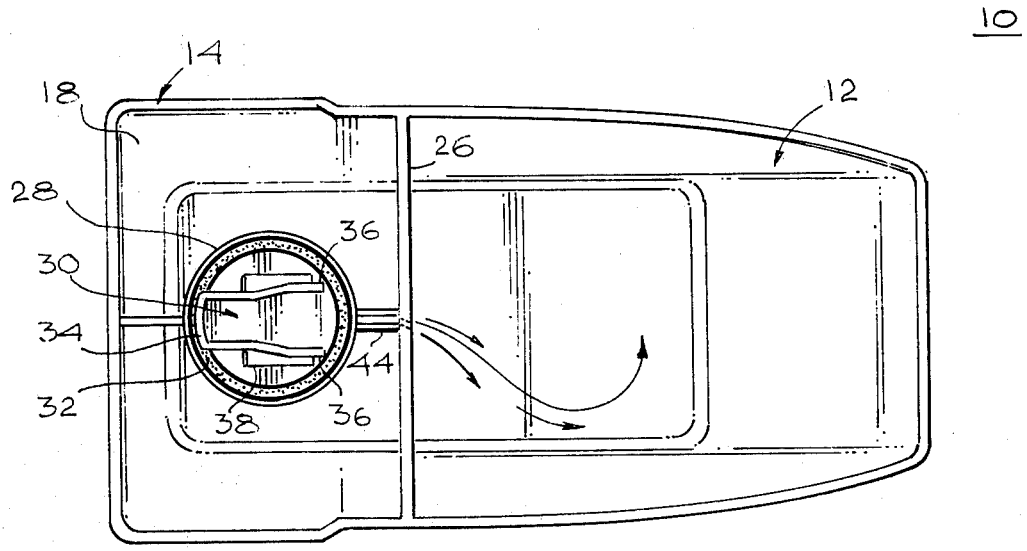
FIG. 2 is a top view of the lower portion of the toilet shown in FIG. 1 with the top of the reservoir, the seat cover, and the seat removed.
Figure 3:
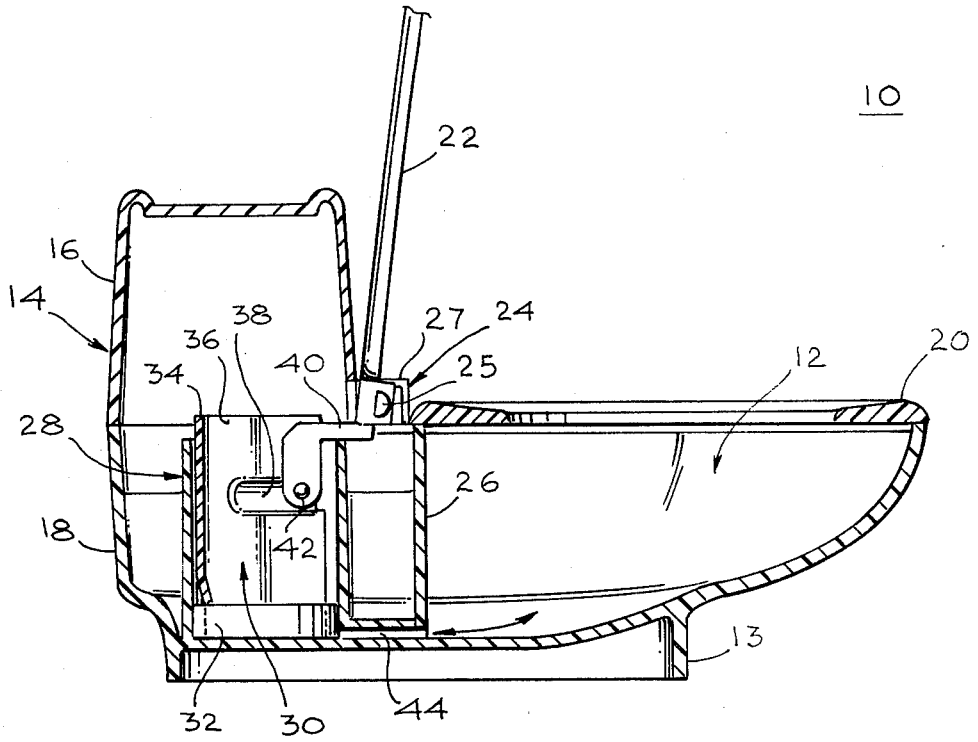
FIG. 3 is a cross-sectional side view of the toy toilet shown in FIG. 1.
Figure 4:
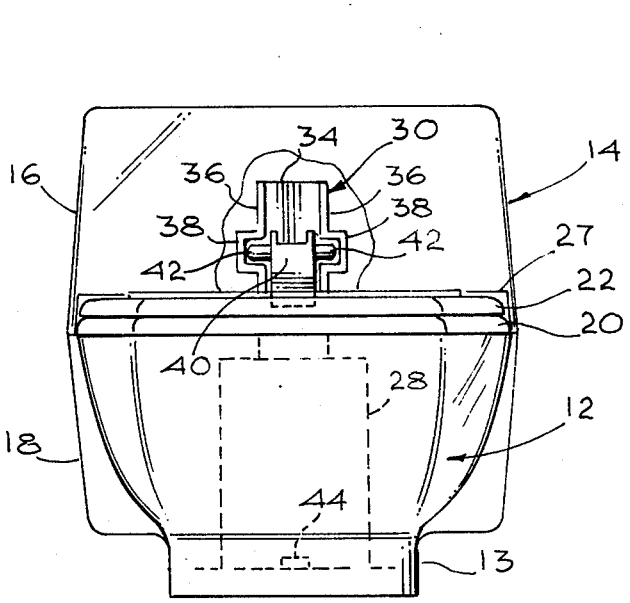
FIG. 4 is a front view of the toy toilet shown in FIG. 1.

Referring now to FIGS. 2, 3, and 4, there are shown various views of a preferred embodiment of the invention. FIG. 2 is a top view looking down on the bowl 12 and the lower portion 18 with the upper portion 16, the seat 20, and the seat cover 22 removed. FIG. 3 is a cross-sectional view of the toy toilet shown in FIG. 1. As may be seen from these two views, the bowl 12 is shaped in the manner of a normal toilet bowl and may preferably be molded from one of the well known moldable plastics. As may be seen from FIGS. 2, the bowl 12 is separated from the lower portion 18 of the reservoir 14 by a wall 26. Positioned within the lower portion 18 of the reservoir 14 is a vertically upstanding cylinder 28 in which is mounted a piston 30 which supports at its lower end a sealing gasket 32. In a preferred embodiment, the cylinder 28 may be molded integrally with the lower portion 18 of the reservoir 14. The gasket 32 is arranged to provide a tight fit for the lower end of the piston 30 in the hollow cylindrical interior of the cylinder 28.

As may be seen in FIGS. 2 and 3, the piston 30 has an upstanding portion 34 with a pair of essentially parallel vertical walls 36. The walls 36 each have a pair of horizontal slotted apertures 38 (best shown in FIGS. 2 and 4). Fixed to and extending from the cover 22 is an arm 40 which projects in the closed position at right angles to the general plane of the cover 22 and then bends at right angles thereto to support a pair of pins 42 which slide in the apertures 38. The arm 40 may be molded integrally with the cover 22 in a preferred embodiment.

The rotation of the seat 22 about the hinges 24 into the open position (as shown in FIG. 3) causes the pins 42 to bear against the lower surface of the apertures 38 and drive the piston 30 to the bottom of the cylinder 28. It may be seen in FIG. 3 that the hinge 24 of the preferred embodiment includes a pair of cylindrical projections 25 extending from the cover 22 and extensions 27 from the upper portion 16 of the reservoir 18 each of which fits over one of the projections 25. Liquid in the cylinder 28 below the piston 30 is driven under pressure through a conduit 44 and into the bowl 12. As may be seen in FIG. 2, the shape of the end of the conduit 44 entering the bowl 12 is such as to cause liquid exiting therefrom into the bowl 12 to be directed toward the side of the bowl 12 to swirl within the bowl 12 as shown by the arrows, emulating a flushing action. Thus, when the cover 22 is raised, any liquid within the cylinder 28 is forced out through the conduit 44 into the bowl 12 and the toy toilet 10 appears to flush. When the cover 22 is lowered, the piston 30 is raised by the action of pins 42 bearing on the upper surface of the apertures 38. This action causes a suction to be created in the lower part of the cylinder 28 which draws water through the conduit 44 from the bowl 12 thereby withdrawing water from the bowl 12.

The position of the arm 40 which holds the pins 42 in the apertures 38 is more clearly shown in FIG. 4 in which the cover 22 is shown in a closed position. In this position, the top of the piston 30 is raised above the edges of the cylinder 28 as may be seen by the dotted outline in FIG. 4. This provides a substantial volume for liquid in the base of the cylinder 28 positioned in the lower portion 18.

While there has been shown and described a preferred embodiment of the invention, it is to be understood that various other adaptations and modifications may be made by those skilled in the art without departing from the spirit and scope of the invention.

What is claimed is:

1. A toy toilet comprising:

a bowl formed to simulate the bowl of a working toilet;

a seat mounted to the upper surface of the bowl;

a cover for the seat;

means rotatably connecting the cover above the seat, including means for hinging the cover to the bowl;

a reservoir mounted to the rear surface of the bowl and including upper and lower chambers wherein the upper chamber extends behind and above the upper surface of the bowl to simulate the water tank of a working toilet;

a cylinder positioned in the lower chamber of the reservoir;

a liquid conduit from one end of the cylinder to the bowl;

a piston adapted to fit in the cylinder to form a liquid tight seal therewith; and means for moving the piston including a linkage from the cover to the piston which moves when the cover is rotated and which forces liquid from the chambers of the reservoir into the bowl to simulate the flushing action of a working toilet when the cover is opened, and which returns liquid from the bowl to the chambers of the reservoir when the cover is closed.

2. A toy toilet as claimed in claim 1, wherein the linkage comprises an arm affixed to the cover and extending adjacent the piston, the arm having a pair of projections extending therefrom, and the piston has a pair of grooves adapted to receive the projections.

* * * * *